US007560137B2

(12) United States Patent
Zoppas et al.

(10) Patent No.: US 7,560,137 B2
(45) Date of Patent: Jul. 14, 2009

(54) PROCESS AND COATING PLANT OF CONTAINERS

(75) Inventors: Matteo Zoppas, Fontanafredda (IT); Alberto Armellin, Vittorio Veneto (IT); Andrea Saran, Tarzo (IT); Ottorino Vendramelli, San Vendemiano (IT)

(73) Assignee: S.I.P.A. Societa Industrializzazione Brogettazione e Automazione S.p.A. (IT)

( * ) Notice: Subject to any disclaimer, the term of this patent is extended or adjusted under 35 U.S.C. 154(b) by 712 days.

(21) Appl. No.: 10/527,503

(22) PCT Filed: Sep. 10, 2003

(86) PCT No.: PCT/EP03/10039

§ 371 (c)(1),
(2), (4) Date: Mar. 10, 2005

(87) PCT Pub. No.: WO2004/024344

PCT Pub. Date: Mar. 25, 2004

(65) Prior Publication Data

US 2006/0019037 A1 Jan. 26, 2006

(30) Foreign Application Priority Data

Sep. 10, 2002 (IT) ..... RM2002A0453

(51) Int. Cl.
*B05D 3/12* (2006.01)
*B02C 13/00* (2006.01)
*B02C 11/08* (2006.01)

(52) U.S. Cl. ..... 427/240; 427/346; 427/384; 427/430.1; 118/52; 118/53; 118/56; 118/421; 118/428

(58) Field of Classification Search ..... 427/240, 427/346, 384, 430.1; 118/52, 53, 56, 421, 118/423, 428
See application file for complete search history.

(56) References Cited

U.S. PATENT DOCUMENTS

| | | | | |
|---|---|---|---|---|
| 3,734,765 | A | 5/1973 | Russell et al. | |
| 3,873,350 | A * | 3/1975 | Dwyer et al. | 427/378 |
| 4,208,454 | A * | 6/1980 | Reed et al. | 427/238 |
| 4,543,277 | A | 9/1985 | Giles | |
| 4,620,985 | A * | 11/1986 | Goodburn et al. | 427/510 |
| 5,211,992 | A * | 5/1993 | Newton et al. | 427/512 |
| 5,658,619 | A | 8/1997 | Kirschner et al. | |
| 7,048,975 | B1 * | 5/2006 | Tojo et al. | 428/34.3 |
| 2003/0194517 | A1 * | 10/2003 | Shi et al. | 428/35.7 |

FOREIGN PATENT DOCUMENTS

| | | |
|---|---|---|
| FR | 1 137 099 | 5/1957 |
| GB | 874 743 | 8/1961 |
| GB | 936 147 | 9/1963 |
| WO | WO 99/65613 | 12/1999 |

* cited by examiner

*Primary Examiner*—Kirsten C Jolley
(74) *Attorney, Agent, or Firm*—Lorusso & Associates

(57) ABSTRACT

A process and relating plant for applying protective coats of paint to containers, especially plastic bottles. The process involves gripping the bottles by means of rotating gripping devices fastened to a conveyor chain, and conveying said bottles to all the different stations involved in the process: coating, drying, and curing. Centrifugation is used to remove any excess coating from the external surface of the bottles, keeping the bottles fastened to the same conveyor chain.

20 Claims, 6 Drawing Sheets

PROCESS AND COATING PLANT OF CONTAINERS

TECHNICAL FIELD

This invention relates to a process and a coating plant for containers. More particularly, it relates to a process and the relating device for coating plastic containers, for example bottles, with protective paint.

BACKGROUND ART

Thermoplastic materials, such as PET (polyethylene terephthalate), have been used for some time now to make containers. This is particularly true for food-containing containers, especially drinks. Although said containers can be of different types, they shall be referred to hereinafter generically as bottles, which happen to be the most popular.

One of the main problems encountered when thermoplastic materials such as PET are used for making bottles is that the necessarily thin and inherently somewhat microporous wall of the formed material make the bottle walls permeable to gas. The result is that oxygen can permeate into the bottle from the outside environment possibly altering the contents of the bottle through oxidation, and carbon dioxide found in carbonated drinks can seep out of the bottle possibly negatively affecting the taste characteristics of the product and damaging the image of the drink manufacturer.

Furthermore, bottles may suffer from impacts during transport, handling, and warehousing leading to visible damage to their outer surface.

To resolve these inconveniences, containers, especially bottles, can be protected with a thin, clear coating that is not very permeable to gas; is able to resist impacts and abrasions if possible; and does not affect the overall appearance of the product.

For example, U.S. Pat. No. 5,658,619 describes a process for coating bottles. This process involves sending bottles to a coating segment where the bottles are gripped and dipped one at a time in one of many containers filled with a coating solution consisting of a resin dispersed in a solvent. Then, after removing the bottles from the coating solution, the bottles are released and sent to a flash-off segment where the solvent of the coating solution is removed from the coating applied to the outer surface of the bottle. After the flash-off process, the bottles are sent to a curing station where the resin of the coating is cured.

Such a plant is complex and not easy to run, particularly when it comes to transferring the bottles from one treatment segment to the next since each segment uses a specific bottle-handling device. Furthermore, this plant requires long drying times, meaning that the time the bottles stay in the drying furnace is very long. The conceivable solution of increasing the drying temperature is not viable due to the low softening point of the thermostatic material used to make the bottle; obviously, this solution could result in deformations to the bottle.

Today, thus, no paint-drying process exists that is simple, effective, and fast; in addition, no relating plant exists that is compact and effective.

OBJECTS OF THE INVENTION

It is an object of this invention to provide a process for applying a protective coating to plastic containers, especially bottles. This coating should improve the impermeability of the bottle to air, and protect the outer surface of the bottle from damage.

It is an object of this invention to provide a process for applying a protective coating to plastic containers, especially bottles, suitable for high-output bottle-making lines; this process must be simple to implement and able to produce high-quality coatings using different types of paints.

It is another object of the invention to provide a plant for carrying out the aforementioned process having high producing capacity, and is cost effective to construct and run.

These objects, in accordance with a first aspect of the invention, are achieved by means of a process for treating the outer surface of containers whereby the containers, such as bottles, are sent to a coating plant that uses a single bottle-transferring and conveying chain. The bottles are secured to the chain with specific grippers as soon as the bottles enter the plant. The bottles are conveyed, while held vertically by the gripping devices, to a coating segment having two or more tanks containing the coating solution. The tanks are movable according to the feeding direction of the chain and are moved sequentially, first, in an upward direction receive several bottles to be dipped into the coating solution at the same time, and, then, in a downward direction in order to remove the bottles from the coating solution.

A protective guard is placed around the bottles after removal from the coating solution. The bottles are spun in order to eliminate any excess paint. Next, the bottles are turned into a horizontal position and rotated slowly around their axes to obtain a uniform thickness paint coating. The bottles are then sent to specific segments of the plant in order to dry and cure the coating.

In accordance with another aspect of the invention, the above objects are achieved by sending the bottles to a coating plant having a single device for conveying bottles, or containers, throughout the plant. This conveyor is provided with a chain and evenly distributed gripping devices, which grip the bottles in a loading station, and are able to rotate on a plane perpendicular to the feeding direction of the conveying device in order to place said bottles, or containers, from a vertical position into a horizontal one.

A coating segment of the plant is located after the bottle-gripping station, comprising two or more paint-filled tanks placed under a wheel or rotating drum around which the device for conveying the bottles winds around in order to change feeding direction. The movement of the tanks is synchronized with the movement of the wheel or drum, and move up or down so that several bottles can be dipped into and removed from each tank.

The coating plant also has devices suitable to spin the bottles for a preestablished amount of time, as well as devices adapted to surround each bottle with a protective guard. The coating plant further has devices suitable to rotate the gripping devices on a plane perpendicular to the feeding direction in order to place the bottles from a vertical position into a horizontal position. The coating plant yet further has devices for drying the paint, and devices for curing the resin contained in the paint.

Other advantages of the invention shall become apparent from the detailed description of preferred embodiments of the invention, given by way of nonlimiting examples that do not exclude further embodiments and improvements.

DESCRIPTION OF THE INVENTION

In accordance with the invention, coating the external surface of containers, especially bottles, with a protective layer of resin involves sending containers to a coating plant, conveying the containers through the coating section of said plant where the containers are dipped into a coating solution, removing the containers from said solution, removing any excess coating solution from the surface of the bottles, removing the solvent of the solution from the coating, and solidifying and curing the resin of the coating. More specifically, this process consists of the following steps:

Using a single bottle-transferring and conveying chain throughout the coating plant:

Securing the bottles to said chain with specific grippers as soon as the bottles enter the coating plant;

Moving said bottles, held vertically by the gripping devices of said chain, to a coating segment comprising many tanks containing the coating solution; said tanks can be moved according to the feeding direction of the chain and sequentially, first, upward in order to each contain several bottles to be dipped into the coating solution at the same time, and, then, downward in order to remove the bottles from the coating solution;

Placing around the bottles removed from the coating solution a protective guard, and, then, spinning the bottles in order to eliminate the excess paint, which is recovered;

Turning the bottles into the horizontal position;

Rotating the bottles slowly around their axis in order to obtain a paint with uniform thickness;

Sending the bottles to specific segments of the plant in order to dry the coating and, then, cure the coating.

Ideally, the bottles, or the containers, are secured to the single transferring chain by means of grippers, which are evenly spaced along the chain, that grip the bottles by the neck placing them in a vertical position.

Said grippers can be rotated on a plane that is perpendicular to the feeding direction of the chain, in order to place the bottles in the horizontal position. Ideally, this rotation takes place thanks to the movement of the chain itself, which turns during the necessary changes in direction.

When the bottles, being conveyed by the chain, reach the tanks containing the coating solution, the tanks are raised one by one in order to contain each several bottles to be coated. At the same time, the tanks also move horizontally: the movement is synchronized with the translation movement of the bottles to be coated; in this way, the bottles are immersed in the coating solution and accompanied in their movement.

The bottles are dipped into and removed from the coating solution at a speed of 120 mm/s at most, preferably between 50 and 200 mm/s.

The total dipping time of the bottles in the coating solution is preferably less than 0.6 s.

After removal from the coating tanks, the bottles remain in the vertical position, a protective guard is raised around the bottles, and the bottles are spun in order to allow most of the excess coating to drip off. Then, the bottles are transferred to the next segment of the plant, the drying station, where they are rotated around their axis longitudinally at a speed of rotation included between 500 and 3000 revolutions per minute, preferably between 500 and 5000 revolutions per minute. Centrifuging time equals 1.5 s, preferably included between 1 and 3 s.

After centrifuging, the grippers of the bottles are rotated so that the bottles are placed in the horizontal position. In this position, the bottles rotate at a speed included between 100 and 300 revolutions per minute, preventing the paint from dripping.

In the coating segment described above, it is feasible to have several groups of bottles at different stages of the process. For example, a first group of bottles may have just entered the coating area, and may be hovering above a rising first tank filled with paint; simultaneously and further along the line, a second group of bottles may be already immersed in a second, fully raised tank; and, finally, simultaneously and further along the line, a third group of bottles may be placed above a third tank that is quickly being lowered. After the coating area, the bottles are transferred to the drying segment where a protective guard is placed around each bottle, and the bottles are spun in order to drain off the excess paint. Then, the rotation of the bottles around their own axis is stopped, and the bottles are quickly sent to the next station where they are placed in the horizontal position before entering the drying furnace.

Finally, the bottles are sent to a coating-drying and/or curing segment.

A two-layer coating can also be used; in this case, after coating, centrifuging, and drying and/or curing the first layer, a second layer of coating is applied to the bottles. This second coat is applied in exactly the same way as the first; furthermore, the bottles are always in the vertical position, and are always held by the same gripping devices of the conveyor chain. This second coating process is followed by identical operations: dripping by centrifugation, and drying and/or curing of the second coat.

The above-described process is carried out by means of a coating plant, comprising the following:

(i) A single device for conveying the bottles, or containers, throughout the plant; this conveyor is equipped with evenly distributed gripping devices that grip the bottles in a loading station, and are able to rotate on a plane perpendicular to the feeding direction of the conveying device in order to place said bottles, or containers, from a vertical position in a horizontal one;

(ii) A coating plant located after the bottle-gripping point that is made up of many paint-filled tanks placed under a wheel or rotating drum (around which said bottles conveying device winds around in order to change feeding direction); the movement of said tanks is synchronized with the movement of said wheel or drum, and also goes up or down so that several bottles can be dipped into and removed from each tank;

(iii) Devices suitable to spin said bottles for a predefined amount of time, and devices adapted to surround each bottle with a protective guard;

(iv) Devices suitable to rotate said gripping devices on a plane perpendicular to the feeding direction in order to place the bottles from a vertical position in a horizontal position;

(v) Devices for drying the paint, and devices for curing the resin contained in the paint.

Preferably, said devices suitable to rotate the gripping devices to place the bottles from a vertical position in a horizontal position, and vice versa later on, are made up of devices for changing the feeding direction of the chain that holds the grippers, meaning that said devices for changing the feeding direction turn the chain.

A plant suitable to carry out the process in accordance with the invention shall be described below, given as a nonlimiting example of the scope and size of the invention and in conjunction with the following accompanying drawings.

Figure 1:
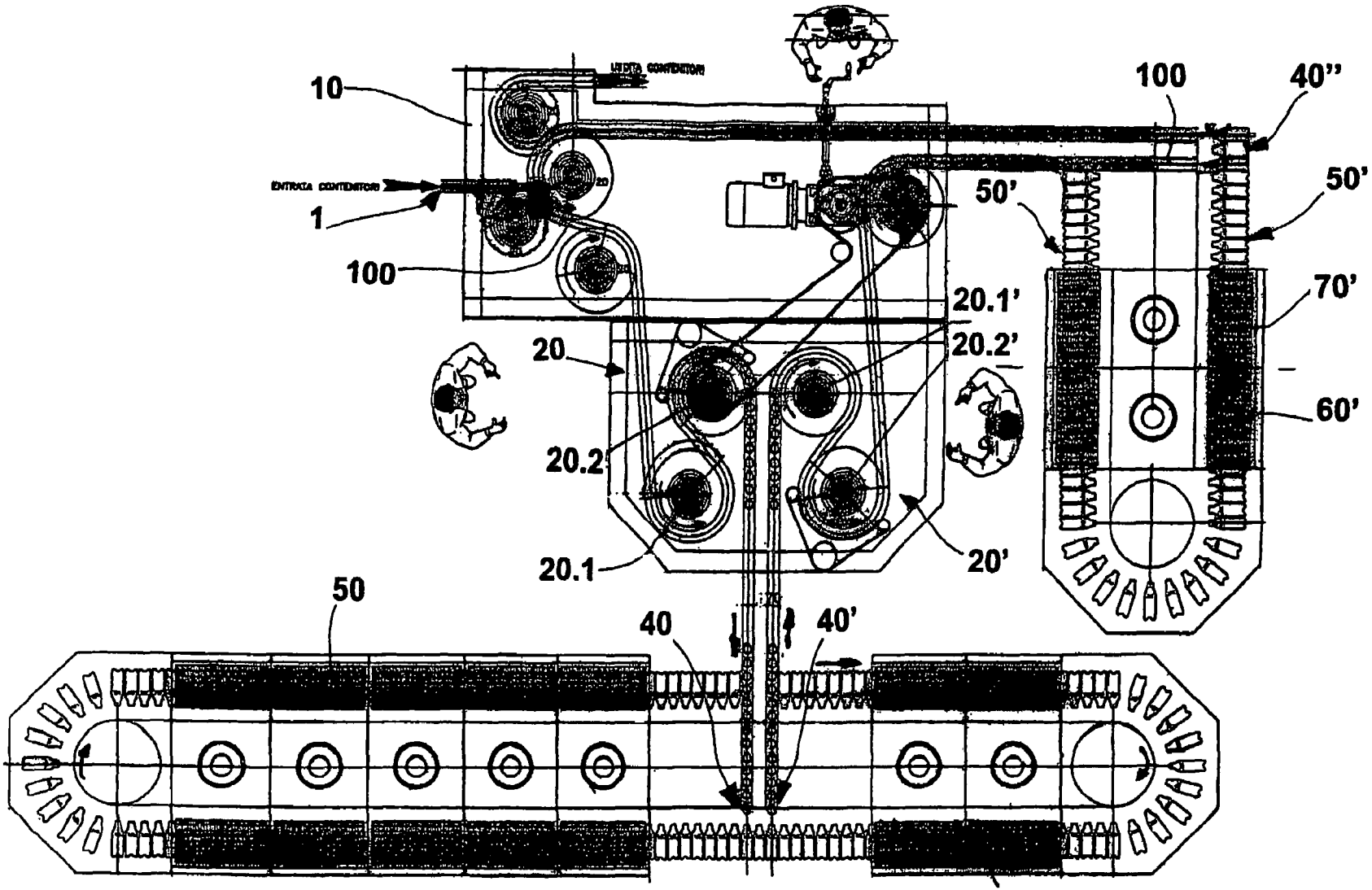
FIG. 1 shows a general schematic view of the plant in accordance with the invention.

Referring to FIG. 1, the plant in accordance with the invention comprises the following elements:

(i) A loading area (10) that the bottles reach after being conveyed by a conveyor (1); the bottles are loaded vertically onto a means of transport (100);

(ii) A coating area (20) comprising a first carousel (20.1) where the bottles are coated through dipping, and a second carousel (20.2) where the same bottles are spun to remove any excess paint;

(iii) An area (40) where the bottles are placed in the horizontal position;

(iv) An area (50) for drying the paint still on the bottles where the remaining solvent is completely removed;

(v) Finally, an area (70) for curing the resin contained in the paint.

Said area (70) is followed by another area (40') of rotation where the bottles are again placed in the vertical position, a coating carousel (20.1') for applying a second layer of paint on the bottles, a centrifuging carousel (20.2'), an area (40'') for rotating the bottles in the horizontal position, a paint-flow area (50') for distributing the paint evenly, in the lower part of the furnace, and an area (60') for curing the resin in the upper part of the furnace, which is similar to the one in the lower part of the furnace.

Figure 2:
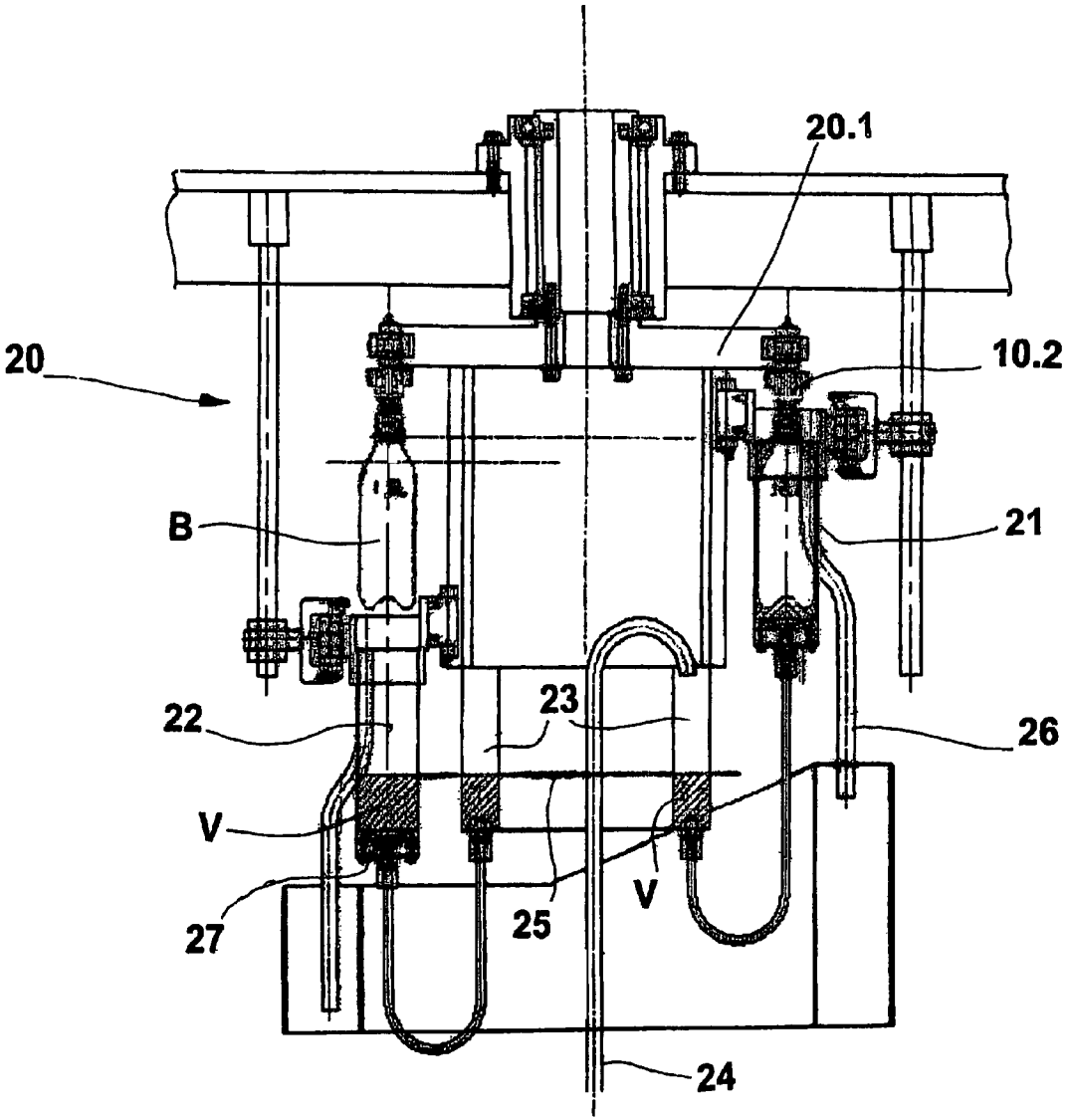
FIG. 2 shows a detailed view of the coating area of the plant.

FIG. 2 shows, in the coating area (20), the conveying means (100—not shown in the Figure)—which is made up of a chain (101—shown better in the following Figures) equipped with gripping devices (102) that each grip the neck of a bottle—winding around a first rotating wheel (20.1), or first carousel, under which there are many tanks (21, 22, and so forth). The movement of said tanks is synchronized with the one of said wheel (20.1); each tank is filled with a coating solution, and is able to contain several bottles. During the process, a sequence is carried out that involves positioning a group of bottles (B) on top of a tank (22), moving the bottles and said tank together while raising the tank to its maximum raised position, dipping the bottles into the coating solution contained in the tank in order to coat them with a first layer of paint, and lowering the tank to remove the bottles from the coating solution.

In this area, the paint (V) is supplied to the tanks by means of a toroidal tank (23) supplied with paint by a pipe (24). In a first embodiment of the invention, the toroidal tank (23) and the tank (22) are connected by means of a pipe (21), like communicating vessels, so that the paint reaches a specific level (25) in said tanks (22 and 23). In another embodiment of the invention, a pump and a rotating joint are used to supply the tank (22) with paint. While the carousel (20.1) is turning, the tank (22) is raised to a specific position (22') so that the bottle (B) is dipped into the paint; a valve (27) prevents the paint from flowing out of the bottom of the tank (22), if one uses the principle of the communicating vessels, while an overflow (26) conveys any paint that overflows from the tank at the raised position to a collecting tank (28) (shown on the right of FIG. 2). If a pump is used (or several pumps if appropriate for the size of the plant), the pump supplies the paint continually through the rotating joint; while, a suction pump is used to eliminate any excess paint through the rotating joint. The two systems, communicating vessels and pump, may be suitably combined if deemed appropriate.

Figure 6:
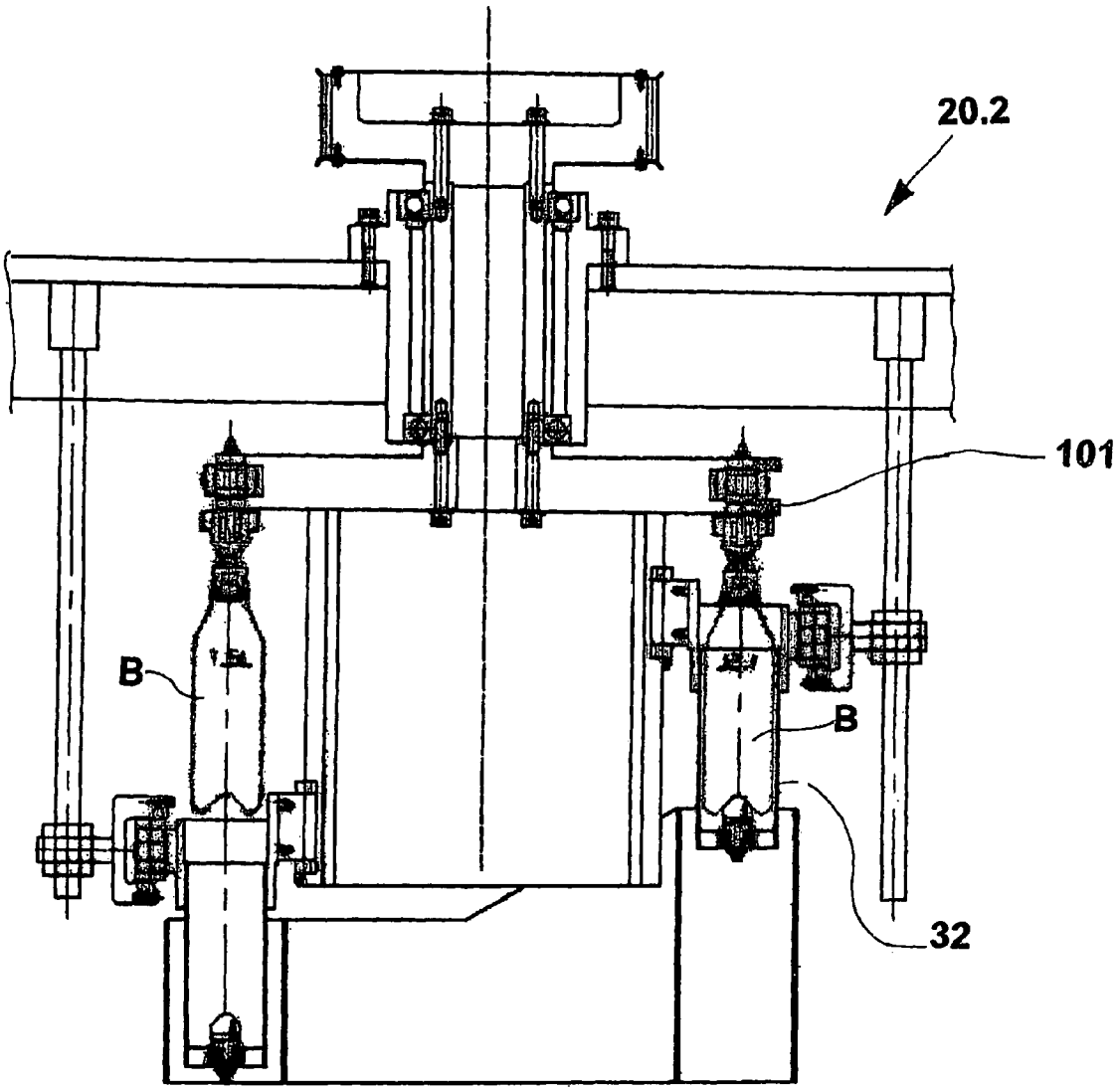
FIG. 6 shows a schematic sectional view of a detail of the plant shown FIG. 1.

Then, the coated bottles are transferred to a second wheel (20.2) or second carousel (sectional view shown in FIG. 6) where a protective device (32) is positioned around each of the bottles (B), and the bottles are rotated quickly around their axis. After this, spinning is stopped, and the bottles exit said second carousel.

Figure 3:
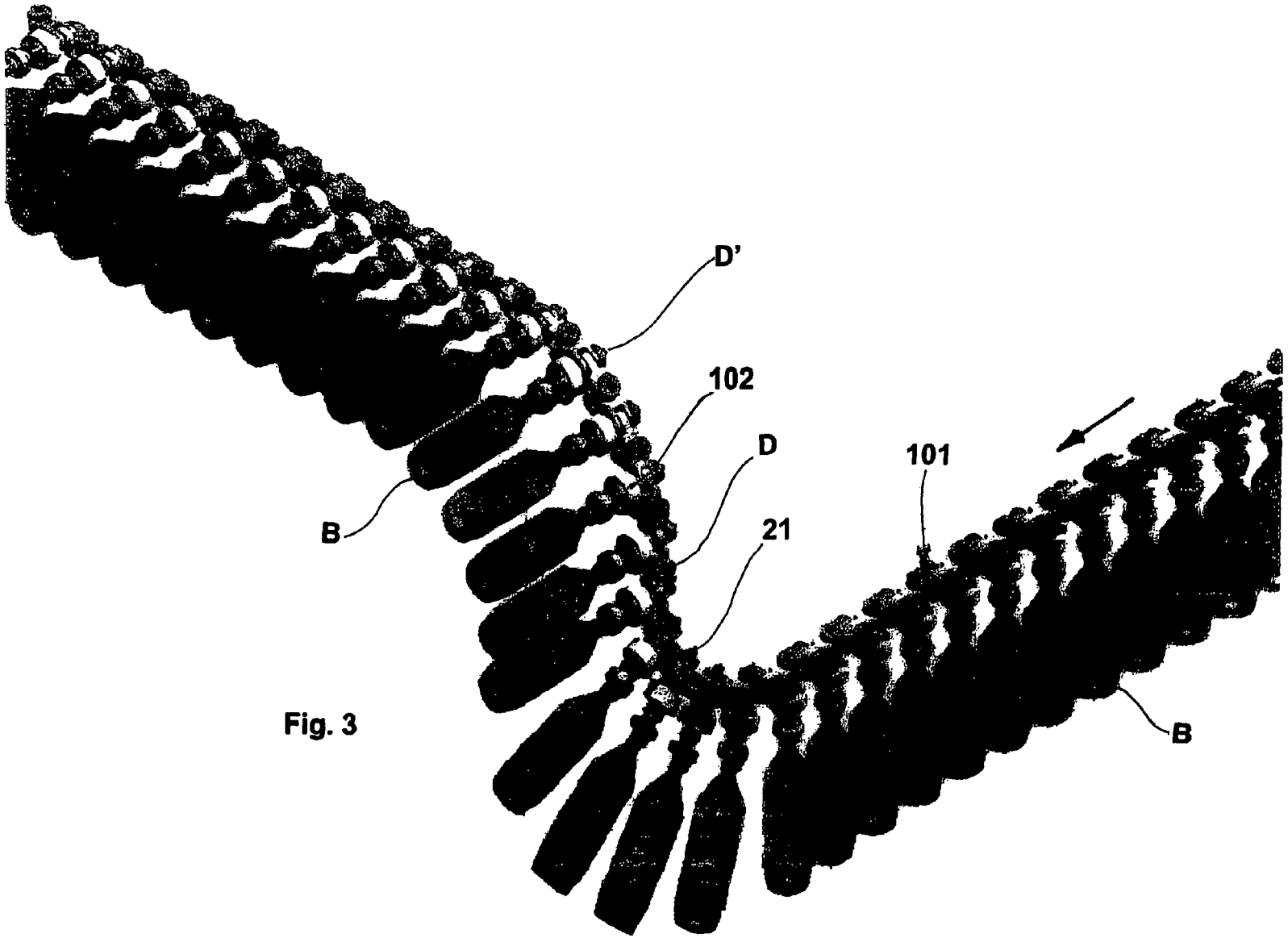
FIG. 3 shows a schematic view of the devices for conveying and gripping the bottles.

FIG. 3 shows a chain (101) moving in the direction of the arrow; in position 21, the chain is bent around its longitudinal axis while its direction of movement is changed, first, vertically (when in position D), and, then, horizontally again (whenin position D') so that the gripping devices (102) are turned to place the bottles (B) in a horizontal position. The bottles are then placed in the drying and/or curing furnace (50) for treating the resin of the first layer of paint.

Figure 4:
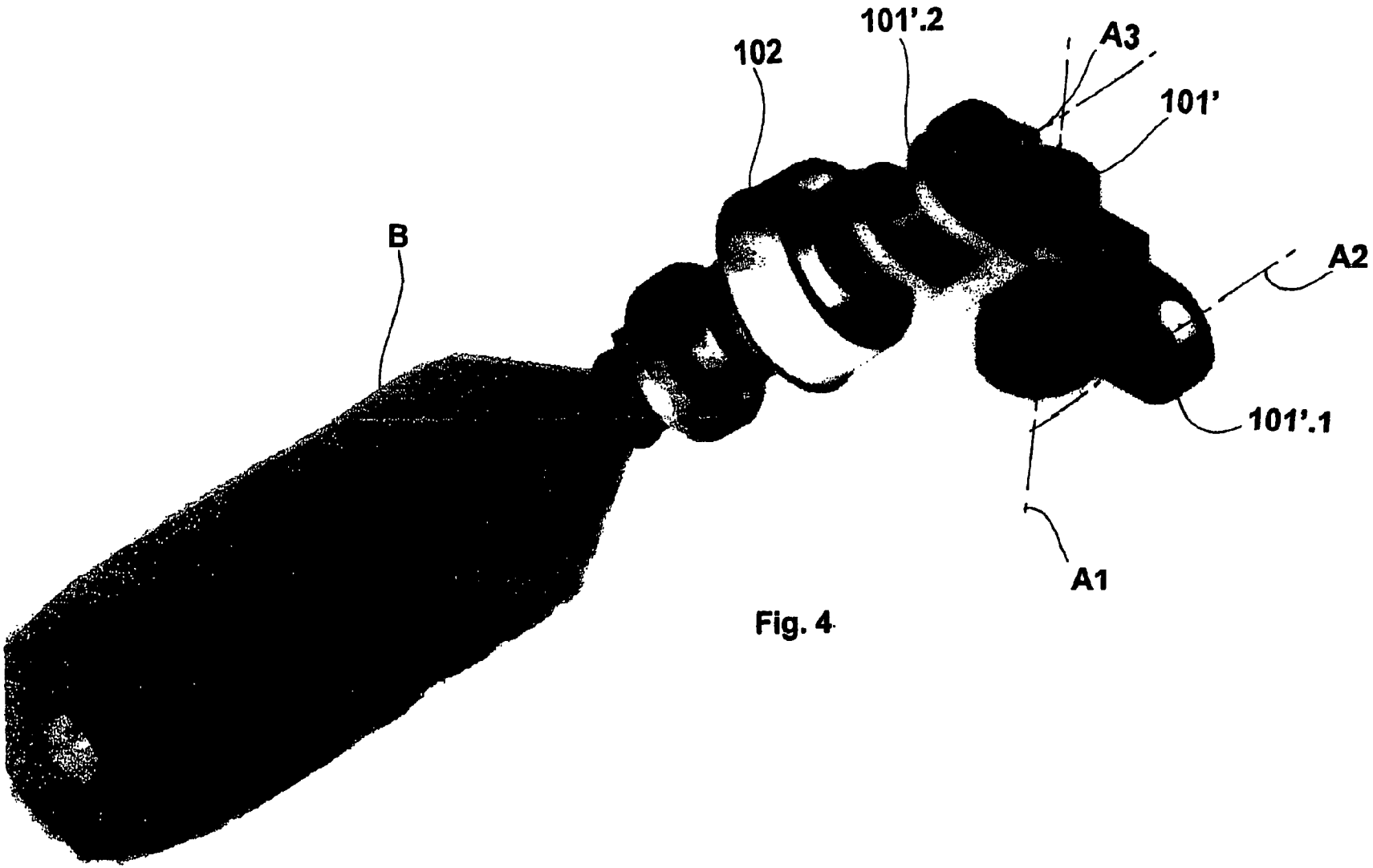
FIG. 4 shows a detailed view of a link of said conveying devices including the relating gripping device and a bottle.

FIG. 4 shows a detailed view of a link (101') of the chain (101) consisting of parts (101'.1 and 101'.2) hinged to each other on the A1 axis; the link (101') is connected to the adjacent links around the A2 and A3 axes, which are parallel to each other and perpendicular to the A1 axis. In this way, this joint can be bent in order to enable the bottles to rotate from a vertical position in a horizontal position, and vice versa, as described above. A gripping device (102) carrying a bottle (B) is found on the A3 axis.

Figure 5:
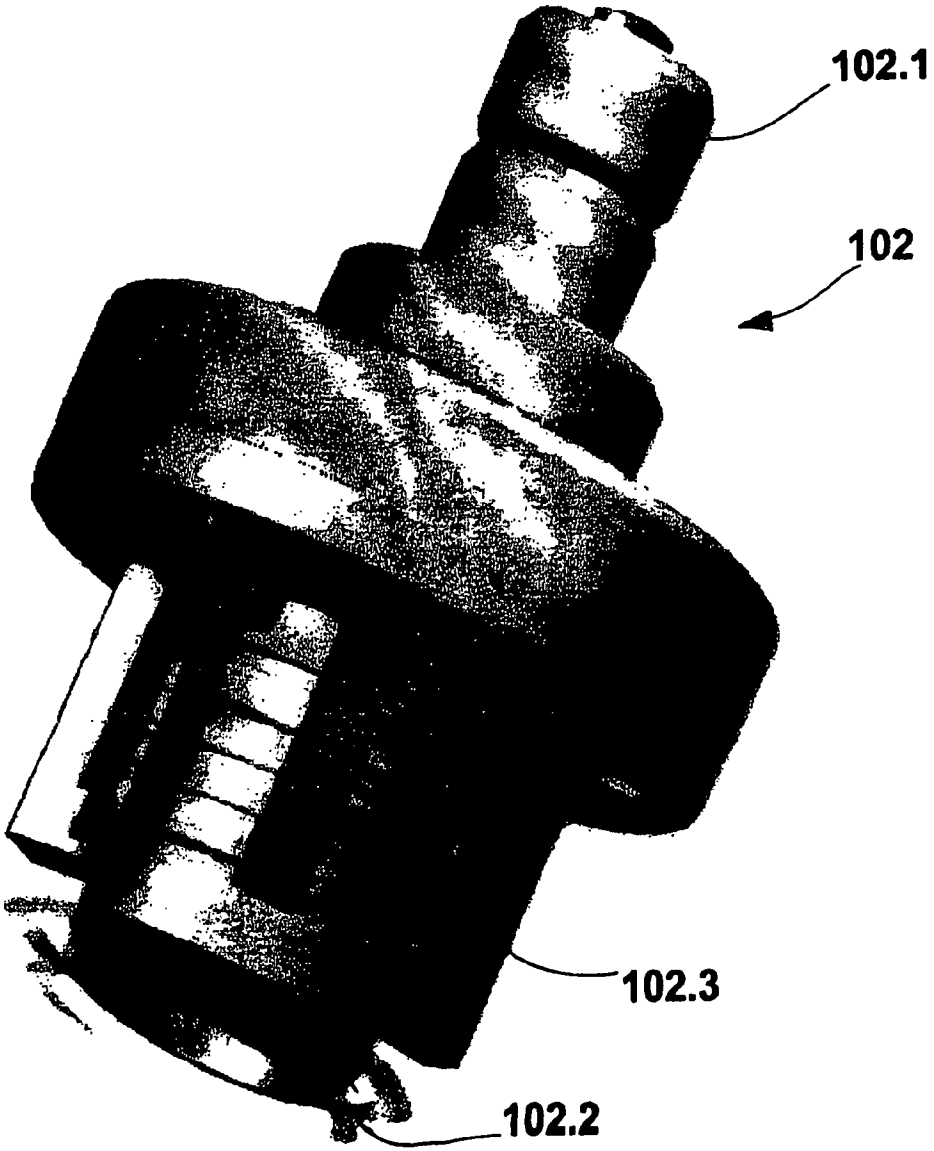
FIG. 5 shows a gripping device.

FIG. 5 shows a gripping device (102) in detail comprising a pin (102.1) that connects to the link (101'), a protrusion (102.2) that fits into the neck of a bottle (not shown), and suitably operated means (102.3) for holding the neck of the bottle around the protrusion (102.2).

The invention claimed is:

1. A process for applying one or more layers of protective resin to the outer surface of containers, especially bottles, comprising sending containers to a coating plant, conveying the bottles through the coating segment of said plant where the containers are dipped into a coating solution, removing said bottles from said solution, removing any excess coating from the outer surface of said bottles, removing the solvent of the solution from the coating, solidifying and curing the resin of the coating; the process comprising the following steps:

Using a single bottle-transferring and conveying chain throughout the coating plant;

Securing the bottles to said chain with specific grippers as soon as the bottles enter the coating plant;

Conveying said bottles, held vertically by the gripping devices of said chain, to a coating segment comprising two or more tanks containing the coating solution; wherein said tanks are movable according to the feeding direction of the chain and sequentially, first, upward in order to each contain several bottles to be dipped into the coating solution at the same time, and, then, downward in order to remove the bottles from the coating solution;

Placing around the bottle, when removed from the coating solution a protective guard, and, then, spinning the bottles in order to eliminate the excess paint;

Turning the bottles into the horizontal position;

Rotating the bottles slowly around their axis in order to obtain a paint with uniform thickness;

Sending the bottles to specific segments of the plant in order to dry the coating and, then, curing the coating.

2. A process as claimed in claim 1 wherein the bottles are secured to the single conveying chain by means of grippers, which are evenly spaced along the chain, that grip the bottles by the neck placing them in a vertical position.

3. A process as claimed in claim 2 wherein said gripping devices can be rotated on a plane that is perpendicular to the feeding direction of the chain, in order to place the bottles in the horizontal position.

4. A process as claimed in claim 1 wherein, after the bottles being transported by the chain reach the tanks containing the coating solution, there is provided the step of raising the tanks one by one in order to contain each several bottles to be coated, while, at the same time, also moving horizontally the tanks, whereby this movement is synchronized with the translation movement of the bottles to be coated.

5. A process as claimed in claim 4 wherein the bottles are dipped into and removed from the coating solution at a speed between 50 and 200 mm/s.

6. A process as claimed in claim 4 wherein the total dipping time of the bottles in the coating solution is preferably less than 0.6 s.

7. A process as claimed in claim 1 wherein there is provided, after removal from the coating tanks, the bottles remaining in the vertical position, a protective guard being raised around the bottles, and the bottles being spun at a speed of rotation comprised between 500 and 5000 revolutions per minute.

8. A process as claimed in claim 7 wherein said speed is comprised between 500 and 3000 revolutions per minute.

9. A process as claimed in claim 7 wherein centrifuging time is comprised between 1 and 3 seconds.

10. A process as claimed in claim 1 wherein there is comprised the step, after leaving the centrifuging area and being positioned horizontally, of rotating the bottles slowly at a speed included between 100 and 300 revolutions per minute.

11. A process as claimed in claim 1 wherein, after drying and/or curing the paint, there is provided applying a second coat of paint to the bottles, subsequently centrifuging, drying, and/or curing, as before.

12. A coating plant comprising:

(i) A single device (100) for conveying bottles (B), or containers, throughout the plant; this conveyor being provided with a chain (101) and evenly distributed gripping devices (102), which grip the bottles (B) in a loading station (10), and are able to rotate on a plane perpendicular to the feeding direction of the conveying device in order to place said bottles (B), or containers, from a vertical position into a horizontal one;

(ii) A coating plant (20), located after the bottle-gripping station (10), comprising two or more paint-filled tanks (22) placed under a wheel or rotating drum (20.1)—around which said device for conveying the bottles winds around in order to change feeding direction, the movement of said tanks being synchronized with the movement of said wheel or drum (20.1), and also comprising going up or down so that several bottles (B) can be dipped into and removed from each tank;

(iii) Devices suitable to spin said bottles for a preestablished amount of time, and devices adapted to surround each bottle with a protective guard;

(iv) Devices suitable to rotate said gripping devices on a plane perpendicular to the feeding direction in order to place the bottles from a vertical position in a horizontal position;

(v) Devices (50) for drying the paint, and devices (70) for curing the resin contained in the paint.

13. A plant as claimed in claim 12 comprising:

(i) A loading area (10) that the bottles reach after being conveyed by a conveyor (1) where the bottles are loaded vertically onto a means of transport (100);

(ii) A coating area (20) where the bottles (B) are coated through dipping, and then spun to remove any excess paint;

(iii) An area (40) where the bottles are placed in the horizontal position;

(iv) An area (50) for drying the paint still on the bottles (B) where the remaining solvent is completely removed;

(v) An area (70) for curing the resin contained in the paint followed by a first area (40') for placing the bottles from the horizontal position in the vertical position.

14. A plant as claimed in claim 13 wherein, after said first area (40'), there are provided the following areas, organized and functioning in the same way as the previous ones; another coating station (20') for applying a second layer of paint and removing any excess paint through centrifuging, an area (40") for placing the bottles from the vertical position in the horizontal position, a paint-flow area (50'), and a paint curing area.

15. A plant as claimed in claim 13 wherein, in the coating area (20), the conveying means (100)—which is made up of a chain (101) equipped with gripping devices (102) that each grip the neck of a bottle (B)—winds around a rotating wheel (20.1) under which there are two or more tanks (22), which also have a movement that is synchronized with the one of said wheel (20.1); each tank is filled with a coating solution, and is able to contain several bottles.

16. A plant as claimed in claim 14 where said tanks (22) are supplied with paint by means of a communicating-vessel device (21, 23) controlling the level of the paint in the tanks.

17. A plant as claimed in claim 14 wherein said tanks (22) are supplied with paint by means of a rotating-joint device controlling the level of the paint in the tanks.

18. A plant as claimed in clam 14 wherein said tank (22) is equipped with a nonreturn valve (27) preventing paint from flowing out of the tanks when these are raised to contain several bottles.

19. A plant as claimed in claim 14 wherein said tanks (22) are supplied with paint by means of a combined pump and rotating-joint device that controls the level of the paint in the tanks, which are equipped with an overflow device.

20. A plant as claimed in claim 11 wherein the bottles are placed from the vertical position in the horizontal one, and vice versa, by bending the chain (101).

* * * * *